US008678395B2

(12) United States Patent
Shoemaker, Jr.

(10) Patent No.: US 8,678,395 B2
(45) Date of Patent: Mar. 25, 2014

(54) BALL DROP GAME

(76) Inventor: Stephen P. Shoemaker, Jr., Redondo Beach, CA (US)

( * ) Notice: Subject to any disclaimer, the term of this patent is extended or adjusted under 35 U.S.C. 154(b) by 101 days.

(21) Appl. No.: 13/402,481

(22) Filed: Feb. 22, 2012

(65) Prior Publication Data

US 2013/0214491 A1 Aug. 22, 2013

(51) Int. Cl.
*A63F 9/00* (2006.01)

(52) U.S. Cl.
USPC ..... 273/460; 273/459; 273/454

(58) Field of Classification Search
USPC ..... 273/440, 441, 447, 448, 454, 459, 460
See application file for complete search history.

(56) References Cited

U.S. PATENT DOCUMENTS 7,637,507 B2 * 12/2009 Peck et al. ..... 273/448
7,857,318 B1 * 12/2010 Shoemaker et al. ..... 273/448
8,070,167 B1 * 12/2011 Shoemaker, Jr. ..... 273/447
8,210,538 B2 * 7/2012 Shoemaker, Jr. ..... 273/288
8,267,405 B1 * 9/2012 Tsai et al. ..... 273/460
8,353,518 B1 * 1/2013 Lai et al. ..... 273/447
2007/0057451 A1 * 3/2007 Halliburton ..... 273/138.1
2011/0086687 A1 * 4/2011 Guarnieri ..... 463/7
2011/0115163 A1 * 5/2011 Guarnieri et al. ..... 273/448
2011/0272887 A1 * 11/2011 Mcgrath ..... 273/448
2012/0228828 A1 * 9/2012 Riggles ..... 273/447

* cited by examiner

*Primary Examiner* — Raleigh W Chiu
(74) *Attorney, Agent, or Firm* — Fulwider Patton LLP

(57) ABSTRACT

An amusement device is disclosed having a housing for enclosing a playing field, and at least one target disposed on the playing field, the target oriented for interaction with a vertically dropped projectile. The device further includes a pick-up device within the housing, the pick-up device suspended from a rail arrangement that provides for four-way horizontal movement over the playing field. The device has player controls including a first control for maneuvering the pick-up device in a horizontal plane above the playing field, and a second control for releasing the projectile, wherein an objective of the amusement device is to position the pick-up device over a target and release the projectile to hit the target to win the prize.

14 Claims, 8 Drawing Sheets

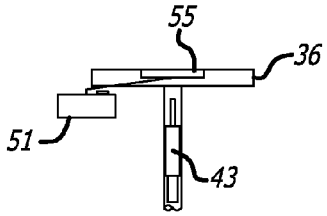
FIG. 6A
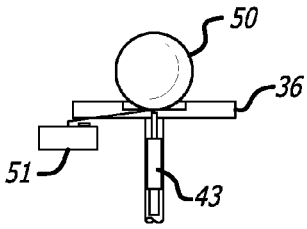
FIG. 6B
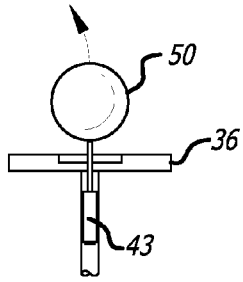
FIG. 6C
FIG. 6D
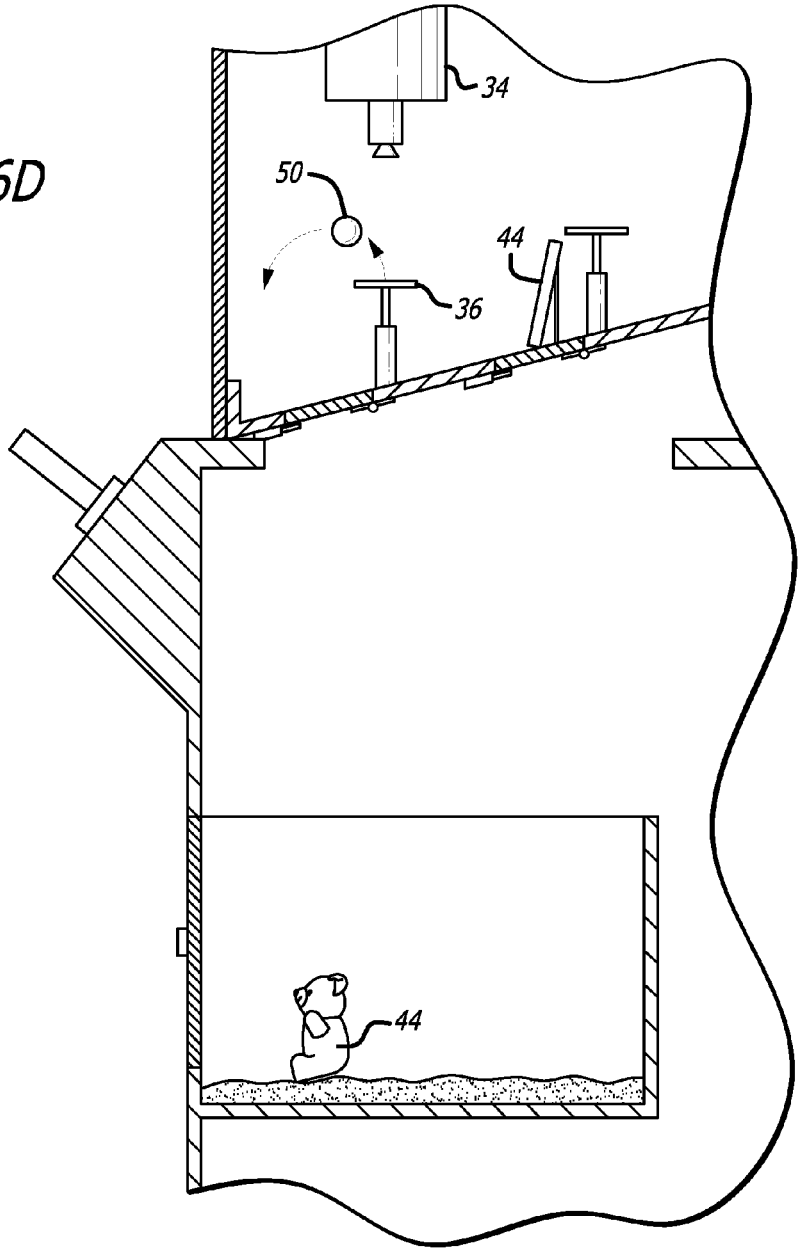

BALL DROP GAME

BACKGROUND

Arcade type games of every variety and kind are becoming increasingly popular toady, and more and more places are utilizing these games to attract customers, particularly kids and young adults. Bowling alleys, pizza parlors, shopping areas, and arcades incorporate these games of skill and chance as a revenue stream and as a way of bring new customers into such establishments. Arcade games are popular with children of all ages, and they allow participants to play a game for the joy of establishing high scores, win prizes, and compete against other players. The present inventor is named on many such arcade machines, having invented a plethora of various style games including those involving cranes and pick-up devices.

The present invention is a reversal on the crane game made so popular in arcades and stores across the country. In a crane game, a collection of prizes is arranged on the floor of a housing, and the player manipulates a crane in an attempt to capture and pick up a prize for collection. If the prize is successfully captured, the player gets to keep the prize. However, there are often issues with both the pick-up mechanism, be it mechanical or vacuum, and the types of prizes that can be successfully picked up by such devices. For example, plush toys were the most predominant type of toy that was used with mechanical crane games because they were able to be captured by mechanical pick-up devices. Conversely, vacuum type crane games cannot easily pick up plush toys, so other types of prizes were needed for these types of games. The present invention eliminates the disparity between the types of pick up devices by providing a new variation on the familiar arcade game.

SUMMARY OF THE INVENTION

The present invention is a ball drop device that is played in a housing with a transparent window. The game uses a ball in most embodiments, although other objects could work depending on the difficulty sought and the variation of the game. The game begins when a player pays for the game, whereupon a pick-up device (mechanical or vacuum for example) captures the ball from its resting place. The pick-up device lifts the ball over the playing field to the top of the housing, where a player can use a joystick or other four way maneuvering device to move the ball in an x-y plane over the playing field. The playing field has arranged at least one target, and preferably a plurality of targets, at the floor of the playing field. The targets may take the form of plates, a bowls, objects with a hole or recess, simple rings, that are oriented to receive the ball dropped from the pick-up device, and each target has a prize associated with it. The prize can be an object of value, a receipt for merchandise, a number of redemption tickets corresponding to the value of the target difficulty, or other item of value. The player attempts to drop the ball into the target, be it a cup, bowl, plate, ring, or the like, by releasing the ball from the pick-up device so that it drops vertically above one of the target. In the case of a bowl, cup, or plate, the target has a sensor that detects when the ball comes to rest on or in the holder, indicating that the player has won the associated prize. In the case of a ring or object with a recess, a sensor detects of the ball is caught by or passes through the ring or object. If the ball misses the target, or bounces off of or out of the target, the floor of the playing field is sloped to return the ball to the starting position, where it can be picked up by the pick-up device. If the ball hits the target, in a first embodiment the target includes a sensor sends a signal to a microprocessor that the player has won the designated prize. The prize can be awarded by a printed ticket that states the prize, or an alarm can sound alerting a clerk to the player's victory. Or the game can dispense the prize by conveying it to a receptacle from which the player can retrieve the prize. The ball can then be ejected from the holder by a kicker, a clerk, or some other mechanism, so that the ball will return to the starting position, awaiting the next play. In some game sequences, there may be a time limit and the player can make as many attempts as time allows.

BRIEF DESCRIPTION OF THE DRAWINGS

FIGS. 6A-6C is a side view of a kicker mechanism for releasing a ball;

FIG. 6D is a cross-sectional schematic view of the embodiment of FIG. 1 showing the operation of the kicker mechanism;

DETAILED DESCRIPTION OF THE PREFERRED EMBODIMENTS

Figure 1:
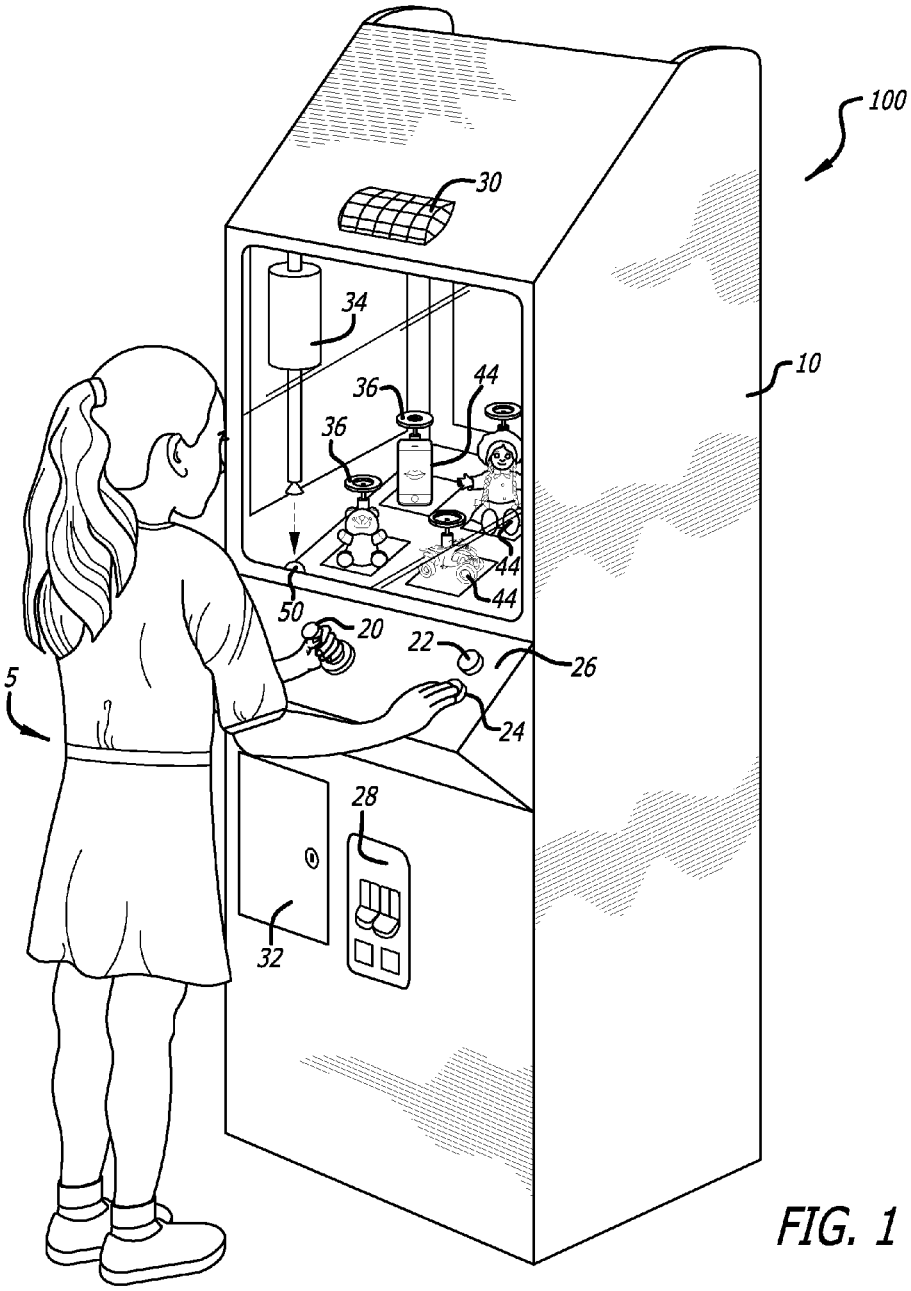
FIGS. 1-3 are elevated, perspective views of a first embodiment of the present invention.

The present invention is general shown in FIG. 1, which illustrates an arcade type game 100 having a housing 10 that encloses a playing area and a playing field 12. The playing field 12 has a number of prizes 44 arranged in various location about the playing field, and a number of targets 36, each associated with a particular prize 44. Although the embodiment of FIG. 1 is illustrated with a plurality of prizes and targets, the game is not limited to multiple prizes and targets and may in fact only have a single prize with a single target. The housing 10 is equipped with various features that allow the game to be played, including a speaker 30, a control area 26 including player controls 20, 22, and 24. A coin slot 28 is provided on the front of the housing, although other forms of payment may be used such as card readers, ticket counters, magnetic strip readers, and dollar bill readers. Also shown in the front of the housing is a prize drawer 32 which, in one preferred embodiment, allows a player to retrieve a prize 44 once successfully won from the game. As will be discussed more fully below, player 5 operates the controls 20, 24 to manipulate a pick-up device 34 which controls the movement of a projectile 50 in an attempt to hit the targets 36.

Figure 2:
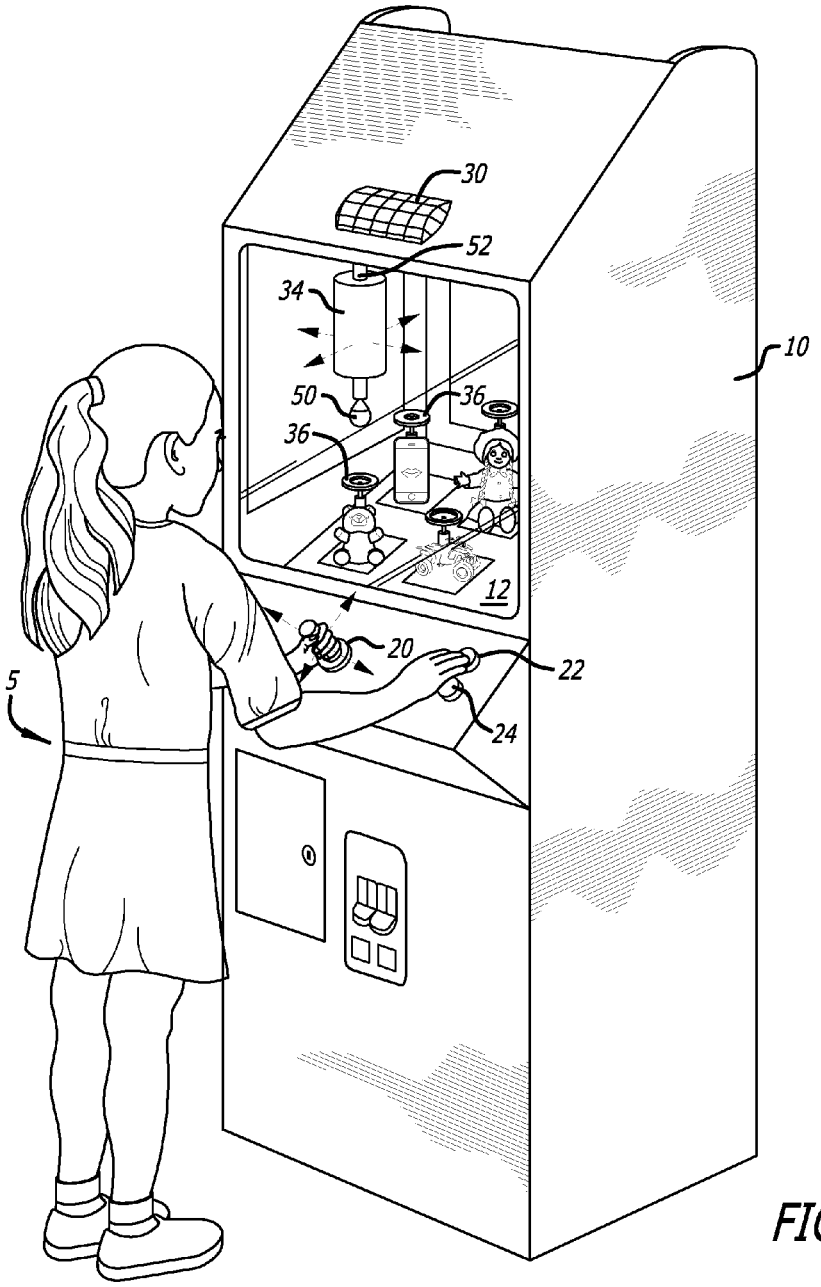

FIG. 2 illustrates player 5 maneuvering a joystick 20, which controls the movement of the pick-up device 34. The joystick 20 has four way movement corresponding to four way (front, back, left, right) horizontal movement of the pick-up device 34 above the playing field 12. The game begins when the player 5 places a coin or other payment in the coin slot 28, which causes the pick-up device 34 to retrieve the projectile 50 from its starting position. In a preferred embodiment, the projectile 50 is a common sphere such as a ball, which may have different weight, texture, and rebound characteristics depending on the desired skill level of the game. The pick-up device 34 collects the projectile 50 and, using a reciprocating member 52, rises above the playing field 12 with the projectile 50 suspended therefrom. From this starting position, the player can manipulate the joystick 20 in any of the four directions to maneuver the pick-up device 34 above the playing field 12. The player 5 maneuvers the pick-up device 34 in order to align the projectile 50 directly above a target 36 so that, when released, the projectile will strike the target in an intended manner.

Figure 3:
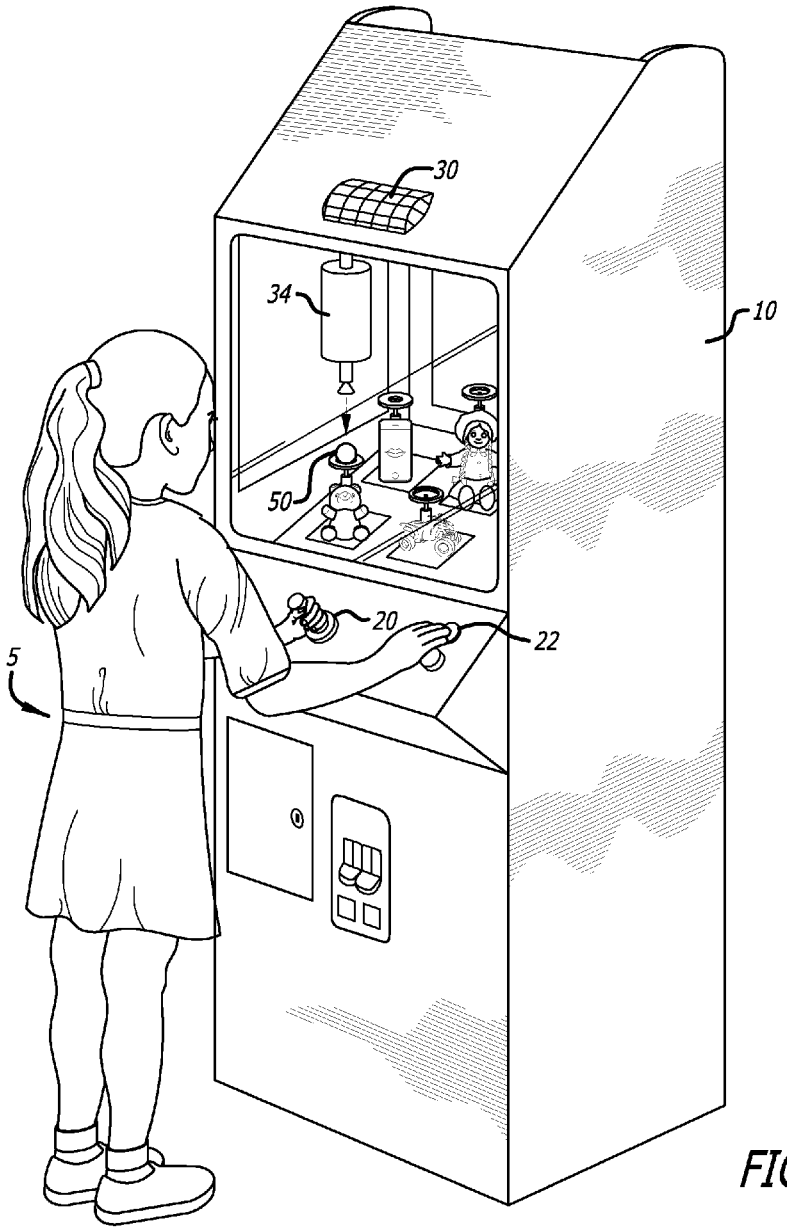
Figure 10:
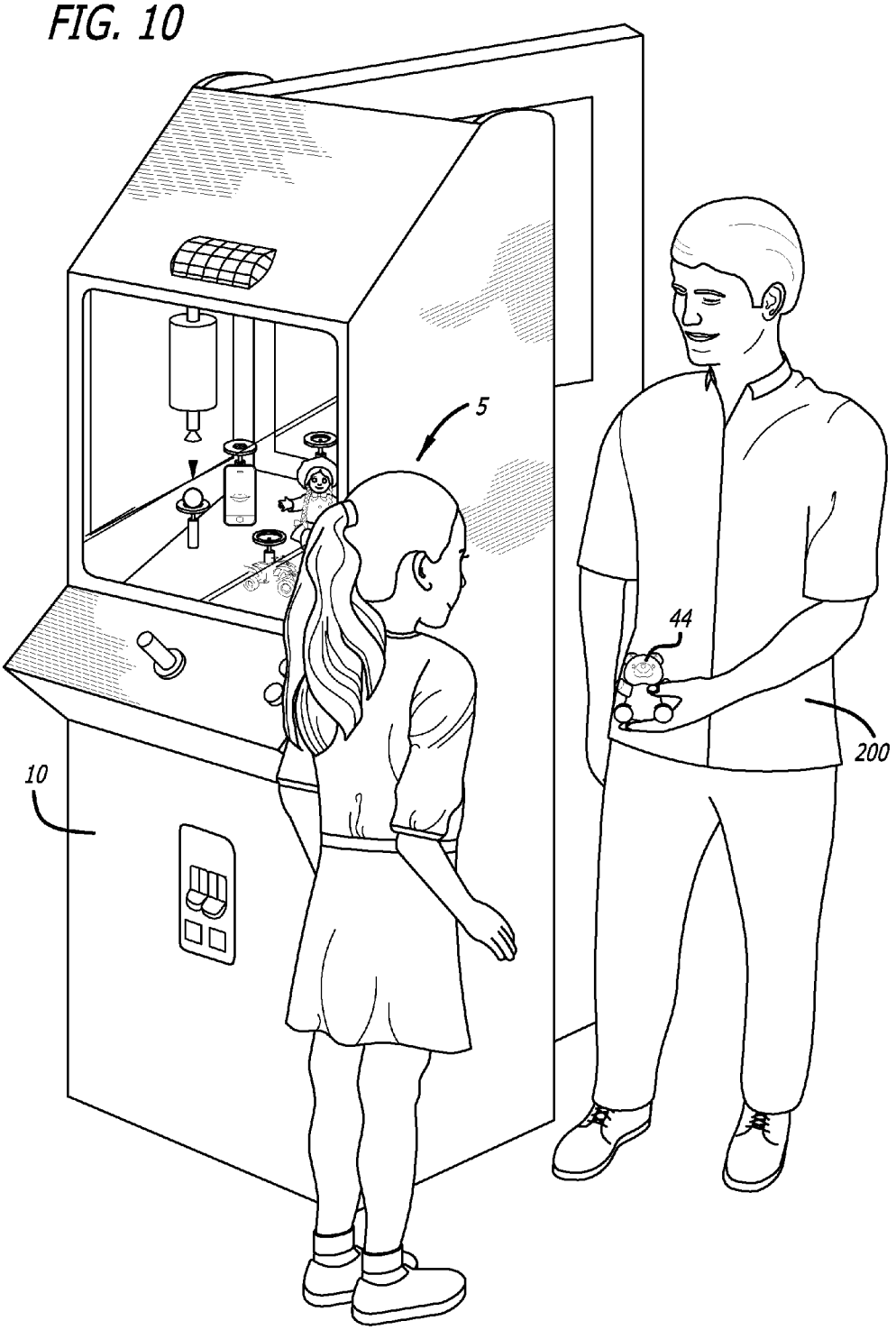
FIG. 10 is an elevated perspective view illustrating a clerk awarding a prize to the participant.

As shown in FIG. 3, if the player has successfully aligned the pick-up device 34 directly over the target 36, the player can then hit a release button 22 that causes the pick-up device 34 to release the projectile 50. If the projectile 50 is captured or otherwise strikes the target 36 in such a way that the projectile is either captured by the target in the case of a solid target or passes through the target in the case of a ringed or recessed target, then the player successfully wins the prize. In one embodiment, as shown in FIG. 10, the successful delivery of the projectile to the target will cause the speaker 30 to emit an audible alarm, which will summon a clerk 200 to the game to retrieve player fives prize 44. An alternate form of prize distribution is disclosed in detail below.

Figure 7:
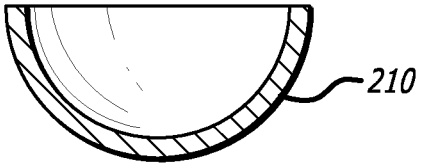
FIGS. 7-9 are cross-sectional views of various shaped targets.
Figure 8:
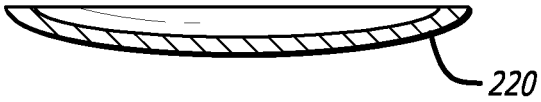
Figure 9:
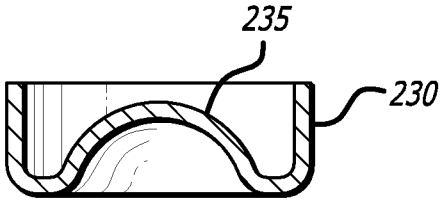

FIGS. 7-9 illustrate possible shapes for targets 36 that capture the projectile dropped from an elevation above the target. FIG. 7 illustrates a cup 210 with a hemispherical configuration. This type of target 36 would be more challenging in that its vertical profile (as viewed from above) is smaller than some alternative targets; however, the raised lateral edges provide some assistance for capturing the projectile and preventing it from rolling off the target. Conversely, FIG. 8 illustrates a shallow bowl or plate 220 that has a larger surface area but lacks a well-defined outer rim that prevents the target from rolling over the edge. A spherical target may have a tendency to roll or bounce off the target of FIG. 8, depending upon the resiliency, weight, size, and other characteristics of the projectile 50. FIG. 9 illustrates yet a third target comprising an inverted cup 235 within a bowl 230. This target could be used with more valuable prizes as it is more challenging to get a spherical projectile to come to rest in such a target without bouncing or rolling over the side.

Figure 4:
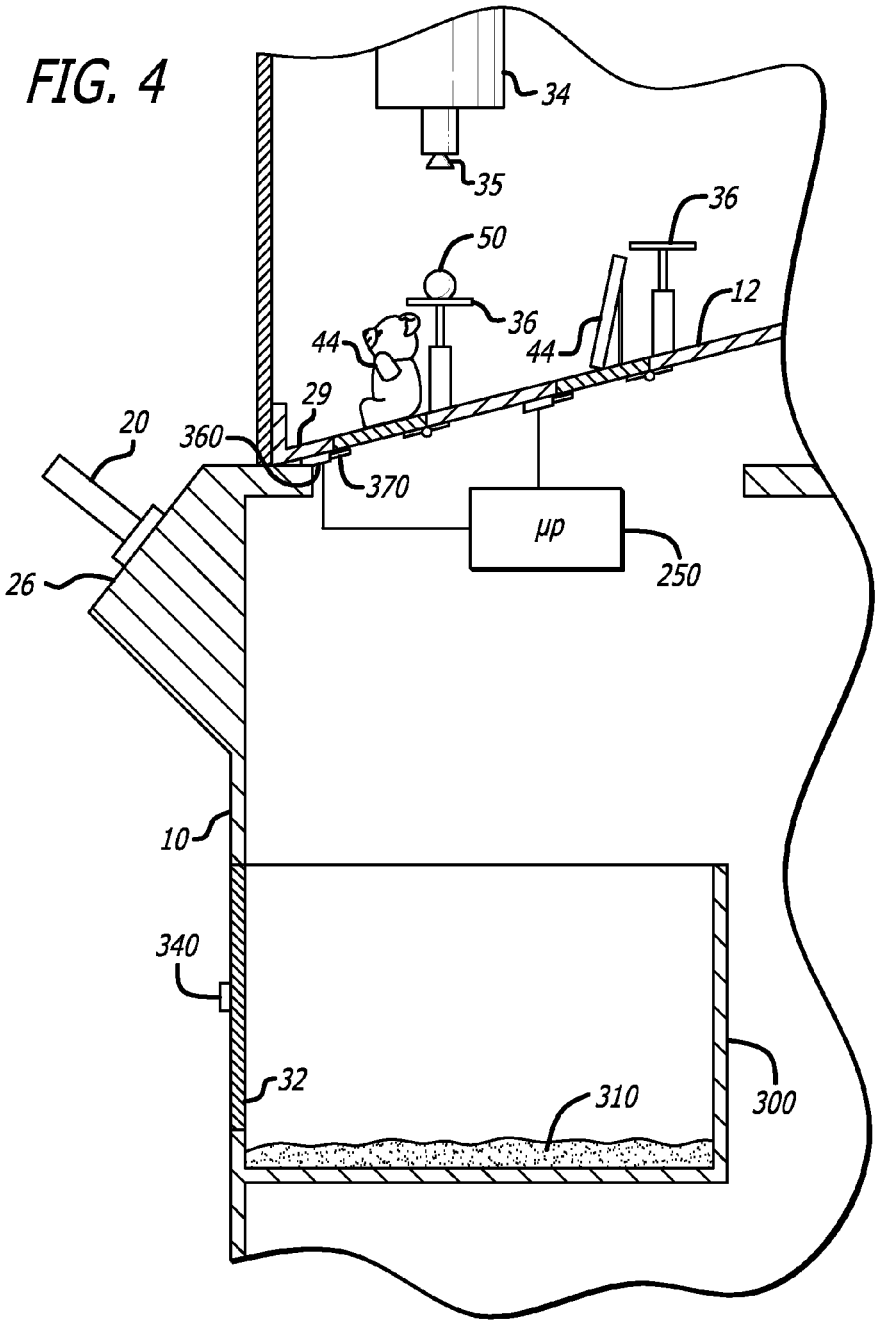
FIGS. 4 and 5 are cross-sectional schematic views of the embodiment of FIG. 1.

FIG. 4 illustrates a cross sectional view of the game illustrating the pick-up device 35 and the sloped playing field 12. The slopped playing field 12 ensures that a spherical projectile 50 will roll to a common starting point of the lowest elevation 29. This makes it easier for the game to always locate the projectile when the game is about to commence. Once the pick-up device 34 using the suction nozzle 35 picks up the projectile 50 at the starting point 29, the pick-up device 34 raises above the playing field as shown in FIG. 4. Using the joystick 20, the player can manipulate the position of the pick-up device in the horizontal direction in a four way manner, namely left, right, back, and front. The movement of the joystick is sent to a microprocessor 250, that controls the operation of the pick-up device as well as other features of the game discussed below. Once the player has positioned the pick-up device 34 directly over the target 36, a button 22 or other such mechanism can be pressed to release the projectile 50 from the pick-up device 34. Under the influence only of gravity, the projectile 50 will drop in a vertical direction until it hits either a target 36, a prize 44, or the playing field 12. Since there is nothing on the prizes 44 that will retain the projectile 50, it will bounce off the prize 44 and roll along the slopped surface of the playing field 12 to the common or initial starting position 29. Similarly, if the projectile misses everything and hits only the slopped playing surface 12, the slop of the playing field will direct the projectile back to the initial position 29.

However, if the player has positioned the pick-up device 34 in precisely the correct location, the projectile 50 will strike the target 36 and, in the case of a bowl or plate shaped target, come to rest on the target 36 as shown in FIG. 4. In this condition, the player has successfully won the prize 44. In a preferred embodiment, the microprocessor 250 is located under the playing field 12, and the target 36 includes a sensor 51 that senses when the target 36 has been successfully hit by the projectile 50. The sensor 51 can be a motion sensor or a weight sensor, or a variety of other sensors that can be used to determine a successful attempt. When the microprocessor 250 receives a signal from the sensor 51 indicating a successful attempt, the microprocessor 250 can perform varies functions that will enable the player to collect his or her prize 44.

Figure 5:
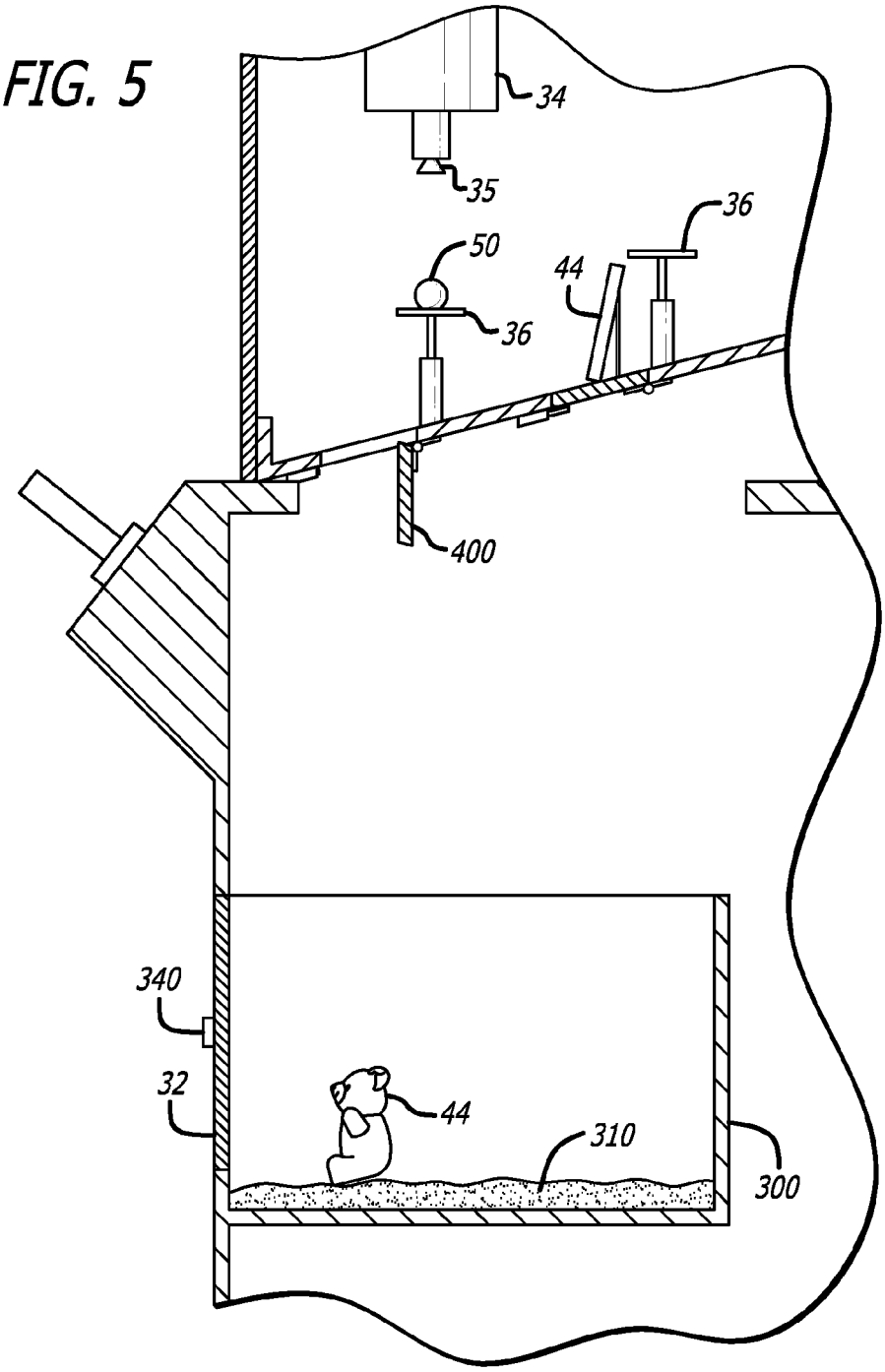

For example, the microprocessor 250 can signal an alarm via the speaker 30 that alerts a clerk or attendant to the occasion of a successfully won prize 44. The alarm could also be accompanied by flashing lights or another visual signal that would draw the attention of the clerk. Alternatively, the microprocessor 250 can release a trap door 400 as shown in FIG. 5 that causes the prize 44 to fall into a collection bin 300. The collection bin 300 can be lined or configured with foam or padding 310 so as not to damage the prize in its fall from the playing field 12 to the collection bin 300. The collection bin 300 can be accessible by the player via a door 32 on the front of the housing, or the collection bin 300 may in an alternative embodiment be accessible only by authorized personnel via a locking mechanism 340. The microprocessor 250 can release the prize 44 via an electronic latch 360 having a protruding tab 370 that projects over the trap door 400. When a signal is received by the microprocessor 250 that a prize has been won, the microprocessor sends a signal to the electronic latch 360 requesting that the tab 370 be withdrawn allowing the trap door 400 to swing downward and the prize 44 resting thereon to fall to the collection bin 300. The trap door 400 can then be reset when a new prize is installed by an attendant or clerk.

FIG. 6 illustrates a kicker mechanism for ejecting the projectile 50 after it has been captured by a target 36. In FIG. 6A, a target 36 is configured with a sensor 51 that determines whether a projectile 50 has come to rest in the designated "win zone" 55. Below the target 36 is a piston having a rod 43 that can reciprocate within the piston in a vertical direction. In FIG. 6B, the projectile 50 has come to rest in the win zone 55 and the sensor 51 has determined this event. The sensor 51 sends a signal to the microprocessor 250, which in turn causes the rod 43, which may be pneumatically or mechanically actuated, to be driven upwards against the projectile 50 as shown in FIGS. 6B and 6C. The rod 43 serves as a kicker to eject the projectile 50 out of the target 36 so that the game can continue without human intervention. This is also shown in FIG. 6D. Other types of kickers could also be used, including wipers, forced air, tilting mechanisms on the target, etc., which return the projectile into play so that the game can continue.

The forgoing descriptions and accompanying illustrations are intended to be illustrative only, and should not be taken to be limiting in any manner with respect to the scope of the present invention. Rather, there are modifications and alternative embodiments that would be understood and appreciated by one of ordinary skill in the art in view of the foregoing description. For example, the type of pick-up device can be mechanical instead of a vacuum device, and the projectile can take many forms. Further, the targets themselves can be of various shapes other than those shown herein. Each of these modifications are intended to be included within the scope of the present invention. Therefore, such modifications and alternative embodiments should be considered to be part of the present invention, and the scope of the invention is limited only by the words of the appended claims using their common and ordinary meaning.

I claim:

1. An amusement device comprising:

a housing for enclosing a playing field;

at least one target disposed on the playing field, the target oriented for interaction with a vertically dropped projectile;

a prize associated with the at least one target;

a pick-up device within the housing including a reciprocating member for lowering the pick-up device to the playing field to retrieve the projectile and raising the pick-up device above the playing field and above the at least one target, the pick-up device suspended from a rail arrangement that provides for four-way horizontal movement over the playing field;

player controls including a first control for maneuvering the pick-up device in a horizontal plane above the playing field, and a second control for releasing the projectile;

wherein an objective of the amusement device is to position the pick-up device over a target and release the projectile to hit the target to win the prize; and wherein the target includes a mechanism for automatically ejecting the ball from the target after a successful hit.

2. The amusement device of claim 1, wherein a floor of the playing field is sloped in two directions to gravitationally direct the projectile to a common location after the projectile reaches the floor of the playing field, and wherein the pick-up device is programmed to pick up the projectile at the common location to begin each game.

3. The amusement device of claim 2, wherein the projectile is a sphere.

4. The amusement device of claim 1, wherein the target is a ring.

5. The amusement device of claim 1, wherein the target is a plate.

6. The amusement device of claim 1, wherein the target is a bowl.

7. The amusement device of claim 1, wherein the target is a cup.

8. The amusement device of claim 1, wherein the target includes a sensor for detecting when the target is hit by the projectile.

9. The amusement device of claim 1, further comprising a microprocessor for receiving a signal from the target when the target is successfully hit by the projectile.

10. The amusement device of claim 9, further comprising an alarm that sounds when the target is successfully hit by the projectile.

11. The amusement device of claim 1, wherein the playing field has a trap door that is actuated when the target is successfully hit to drop the prize into a collection bin where it can be retrieved by a player.

12. The amusement device of claim 1, where the first control is a joystick.

13. The amusement device of claim 1, wherein the pick-up device is a vacuum mechanism.

14. The amusement device of claim 1, wherein the pick-up device is a mechanical claw.

* * * * *